US008348784B2

(12) United States Patent
Gilbert et al.

(10) Patent No.: US 8,348,784 B2
(45) **Date of Patent: *Jan. 8, 2013**

(54) GOLF CLUB HEAD WITH VARYING FACE GROOVES

(75) Inventors: Peter J. Gilbert, Carlsbad, CA (US); Charles E. Golden, Encinitas, CA (US); Robert W. Vokey, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/361,166

(22) Filed: Jan. 30, 2012

(65) Prior Publication Data

US 2012/0122605 A1 May 17, 2012

Related U.S. Application Data

(60) Division of application No. 13/045,084, filed on Mar. 10, 2011, now Pat. No. 8,109,840, which is a division of application No. 12/107,272, filed on Apr. 22, 2008, now Pat. No. 7,905,797, which is a continuation-in-part of application No. 12/007,223, filed on Jan. 8, 2008, now Pat. No. 7,862,450, which is a continuation-in-part of application No. 11/711,096, filed on Feb. 27, 2007, now Pat. No. 7,568,983, which is a continuation-in-part of application No. 10/902,064, filed on Jul. 30, 2004, now Pat. No. 7,273,422.

(60) Provisional application No. 60/528,708, filed on Dec. 12, 2003.

(51) Int. Cl.
*A63B 53/04* (2006.01)

(52) U.S. Cl. ..... 473/330; 473/331

(58) Field of Classification Search ..... 473/324–350, 473/287–292

See application file for complete search history.

(56) References Cited

U.S. PATENT DOCUMENTS

| | | | |
|---|---|---|---|
| D192,366 | S | 3/1962 | Penna |
| 4,413,825 | A | 11/1983 | Sasse |
| 4,529,203 | A | 7/1985 | Ribaudo |
| 4,869,508 | A | 9/1989 | Miller |
| 5,029,864 | A | 7/1991 | Keener |
| 5,295,686 | A | 3/1994 | Lundberg |
| 5,358,249 | A | 10/1994 | Mendralla |
| 5,437,088 | A | 8/1995 | Igarashi |
| 5,505,450 | A | 4/1996 | Stuff |
| 5,591,092 | A | 1/1997 | Gilbert |
| 5,601,498 | A | 2/1997 | Antonious |
| 5,637,044 | A | 6/1997 | Swash |
| 5,688,186 | A | 11/1997 | Michaels et al. |
| 5,766,087 | A | 6/1998 | Kawamatsu |

(Continued)

*Primary Examiner* — Sebastiano Passaniti

(74) *Attorney, Agent, or Firm* — Michael J. Mancuso

(57) ABSTRACT

The present invention is directed to a golf club head with an improved striking surface. Grooves are machined into the strike surface with tight tolerances. The grooves have sharp edges, radiused ends, and a draft angle between about 2° and 12°. The striking face is machined such that it has a uniform texture with a roughness of more than 40 Ra. The grooves may contain a plurality of portions, including a radiused or angled portion, a portion having substantially parallel walls, a portion having a v-shape, and a curved portion. The grooves may also be characterized by various dimensions, including draft angle, inclusive side wall angle, width, depth, cross-sectional area, spacing, and pitch ratio. Preferred values for these dimensions are provided. A golf club head having a variety of groove types and a set of golf clubs with grooves varying among the individual clubs of the set are also disclosed.

20 Claims, 7 Drawing Sheets

U.S. PATENT DOCUMENTS

| | | | | |
|---|---|---|---|---|
| 6,099,414 | A | 8/2000 | Kusano et al. | |
| 6,224,497 | B1 | 5/2001 | Antonious | |
| 6,348,010 | B1 | 2/2002 | Doolen | |
| 6,348,011 | B1 | 2/2002 | Reyes et al. | |
| 6,398,665 | B1 | 6/2002 | Antonious | |
| 6,605,006 | B2 | 8/2003 | Mason | |
| 6,733,400 | B2 | 5/2004 | Sherwood | |
| 6,739,984 | B1 | 5/2004 | Ciasullo | |
| 6,814,673 | B2 | 11/2004 | Wahl et al. | |
| 6,890,270 | B2 | 5/2005 | Ciasullo | |
| 6,981,923 | B2 | 1/2006 | Chappell | |
| 7,014,568 | B2 | 3/2006 | Pelz | |
| 7,056,226 | B2 | 6/2006 | Kennedy | |
| 7,192,361 | B2 | 3/2007 | Gilbert et al. | |
| 7,273,422 | B2 | 9/2007 | Vokey et al. | |
| 7,285,057 | B2 | 10/2007 | Mann, Jr. et al. | |
| 7,473,187 | B2 | 1/2009 | Vokey et al. | |
| 7,540,810 | B2 | 6/2009 | Hettinger et al. | |
| 7,568,983 | B2 | 8/2009 | Gilbert | |
| 7,653,980 | B2 | 2/2010 | Vokey et al. | |
| 7,658,685 | B2 | 2/2010 | Vokey et al. | |
| 7,862,450 | B2 | 1/2011 | Gilbert et al. | |
| 7,905,797 | B2 | 3/2011 | Gilbert et al. | |
| 7,955,189 | B2 * | 6/2011 | Vokey et al. | 473/330 |
| 8,109,840 | B2 * | 2/2012 | Gilbert et al. | 473/330 |
| 2005/0043113 | A1 | 2/2005 | Mann et al. | |
| 2008/0125241 | A1 | 5/2008 | Tateno et al. | |

* cited by examiner

GOLF CLUB HEAD WITH VARYING FACE GROOVES

CROSS-REFERENCE TO RELATED APPLICATIONS

This is a divisional of U.S. patent application Ser. No. 13/045,084, filed Mar. 10, 2011, now U.S. Pat. No. 8,109,840 now pending, which is a divisional of U.S. patent application Ser. No. 12/107,272, filed Apr. 22, 2008, now U.S. Pat. No. 7,905,797, which is a continuation-in-part of U.S. patent application Ser. No. 12/007,223, filed Jan. 8, 2008, now U.S. Pat. No. 7,862,450, which is a continuation-in-part of U.S. patent application Ser. No. 11/711,096 filed on Feb. 27, 2007, now U.S. Pat. No. 7,568,983, which is a continuation-in-part of U.S. patent application Ser. No. 10/902,064 filed on Jul. 30, 2004, now U.S. Pat. No. 7,273,422, which are incorporated herein by reference in their entireties.

This application claims the benefit of U.S. Provisional Patent Application No. 60/528,708 filed on Dec. 12, 2003, which is incorporated herein by reference in its entirety.

BACKGROUND OF THE INVENTION

1. Field of the Invention

The present invention relates to golf clubs. In particular, the present invention relates to a golf club head having an improved striking surface.

2. Description of the Related Art

Golf club heads come in many different forms and makes, such as wood- or metal-type, iron-type (including wedge-type club heads), utility- or specialty-type, and putter-type. Each of these styles has a prescribed function and make-up.

Iron-type and utility-type golf club heads generally include a front or striking face, a top line, and a sole. The front face interfaces with and strikes the golf ball. A plurality of grooves, sometimes referred to as "score lines," is provided on the face to assist in imparting spin to the ball. The top line is generally configured to have a particular look to the golfer and to provide structural rigidity for the striking face. A portion of the face may have an area with a different type of surface treatment that extends fractionally beyond the score line extents. Some club heads have the surface treatment wrap onto the top line. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The United States Golf Association (USGA) publishes and maintains the Rules of Golf, which govern golf in the United States. Appendix II to the USGA Rules provides several limitations for golf clubs. For example, the width of a groove cannot exceed 0.035 inch, the depth of a groove cannot exceed 0.020 inch, and the surface roughness within the area where impact is intended must not exceed that of decorative sand-blasting or of fine milling. The Royal and Ancient Golf Club of St Andrews, which is the governing authority for the rules of golf outside the United States, provides similar limitations to golf club design.

U.S. Pat. No. 6,814,673 is directed to grooves for iron-type golf clubs.

SUMMARY OF THE INVENTION

The present invention relates to golf clubs. In particular, the present invention relates to a golf club head having an improved striking surface. The golf club head of the present invention has a flat striking face, preferably being milled. This allows a greater degree of flatness than typically seen. Preferably, the face is flat within ±0.002 inch. Grooves or score lines are then cut into the flattened face. Typically, grooves are formed in the face as part of the head-forming process. For example, if the head is cast, typical grooves are formed as part of the casting process. The face—including the grooves—is then subject to post-casting process steps, such as polishing. Similar finishing steps are also typically performed on club heads that are formed by forging. Machining grooves in the face after it has been milled beneficially saves them from being affected by any face post-manufacturing processes, which can adversely effect, for example, the groove-face interface, making it inconsistent along the length of the groove.

Preferably, the grooves are angled or otherwise ramped from their maximum depth into the face to the face surface at the groove ends. This helps facilitate cleaning sand, dirt, and other debris from the grooves. This may be characterized in a variety of manners, for example, the maximum depth distance of the groove (that is, the non-ramped, or non-radiused, portion of the groove) versus the overall length of the groove. In one preferred embodiment, the overall groove length is at least 0.25 inch longer than the maximum depth distance. As another example, the grooves may be radiused at toe and heel portions of the golf club head, a preferred radius range being from 0.125 inch to 5 inches. The maximum depth of the grooves may be about 0.02 inch deep at a geometric center of the face.

The grooves of the present invention preferably are formed by spin milling or fly cutting. Forming the grooves in this manner allows for tighter draft angles, increases the rate of production, and allows for tighter tolerances than casting or forging. Preferably, the draft angle of the inventive grooves is between about 0.5° and 12°. The grooves may be formed by a round cutter, preferably having a diameter from ⅜ inch to ¾ inch. A preferred draft angle range is from about 0.5° to 12°.

The surface of the club face may be textured or roughened. Providing a textured strike face allows the golfer to apply more friction to the ball during use, allowing the golfer to put more spin on the ball and have greater control of the ball. Preferably, the surface has a substantially uniform textured surface with a roughness greater than 40 Ra.

The present invention also includes a method of making the golf club head described above. One preferred method includes forming a golf club head in known fashion, such as casting or forging. The strike face, which does not yet contain any grooves, is then machined to be substantially flat. Grooves are then machined in the face, and the face is roughened. These last two steps may be performed individually, in either order, or they may be performed simultaneously.

The club head of the present invention may contain grooves having a plurality of portions. A first portion adjacent to and interacting with the club head strike face may be radiused or angled relative to the strike face. A second portion, adjacent to the first portion, may be defined by substantially parallel walls that are substantially perpendicular to the strike face. A third portion may have an v-shape and be angled at approximately 90°. A fourth section may be curved, having a small radius, to join the walls of the third portion.

The grooves may also be characterized by various dimensions, including draft angle, inclusive side wall angle, width, depth, cross-sectional area, spacing, and pitch ratio. Preferred values for these dimensions are provided below.

A golf club head of the present invention may include various type of grooves. This beneficially allows the golf club designer to provide different grooves at different locations of the striking face to accommodate different types of golf swings and/or shot conditions. For example, standard grooves may be used on the lower portion of the club face near the sole, and spin milled grooves may be used on the upper portion of the club face near the top line. This groove arrangement, as well as others described in more detail below, provides a bias of groove volume toward either the top (toward the top line) or the bottom (toward the sole) of the club head. Grooves may also be varied among the various clubs forming a set of clubs.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
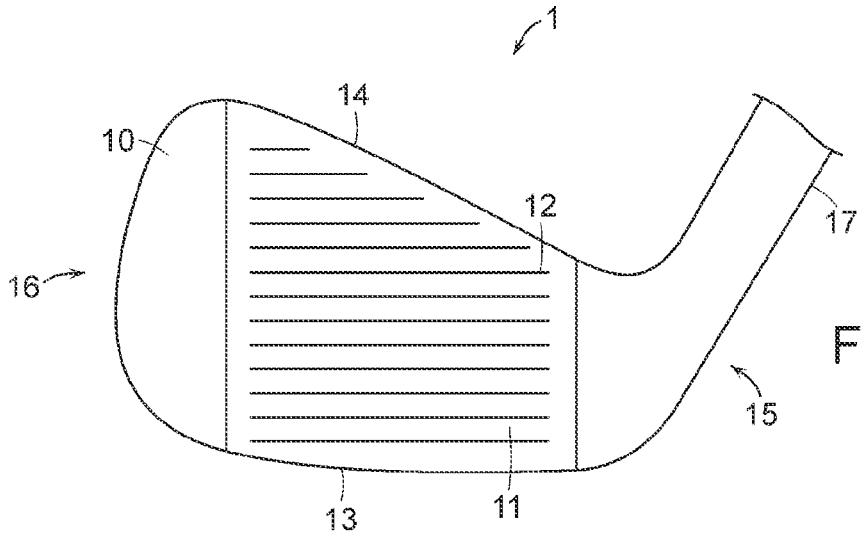
FIG. 1 shows a golf club head of the present invention.

The present invention is directed to a golf club head with an improved striking surface. FIG. 1 shows a golf club head 1 of the present invention. The golf club head 1 includes a body 10 defining a front surface 11, a sole 13, a top line 14, a heel 15, a toe 16, and a hosel 17. The striking face of the front surface 11, which contains grooves 12 therein, and the sole 13 may be unitary with the body 10, or they may be separate bodies, such as inserts, coupled thereto. While the club head 1 is illustrated as an iron-type golf club head, the present invention may also pertain to a utility-type golf club head or a wood-type club head.

Figure 2:
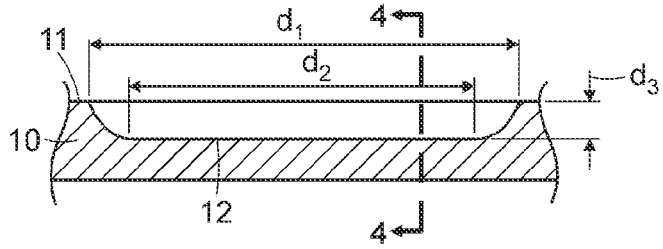
FIG. 2 shows a cross-sectional view of a club head of the present invention along a groove.

FIG. 2 shows a cross-sectional view of the club head 1 along a groove 12. Grooves 12 are machined into the surface of the striking face 11, which allows the draft angle to be decreased. Grooves 12 extend from a toe end of the club head 1 to a heel end of the club head 1. The grooves 12 are shallow at both the toe and heel portions of the club head 1, and are deep in the central regions. Grooves 12 have a first distance d1 measured along the surface of striking face 11 and a second distance d2 measured along the deepest portion of the grooves, which have a depth d3. Thus, first distance d1 is an overall distance and second distance d2 is a maximum depth distance. Preferably, the groove depth along the maximum depth distance d2 is substantially constant. In one embodiment the maximum depth distance d2 is at least 0.25 inch shorter than the overall distance d1. The groove draft angle $\alpha$ ranges from about 0.5° to 12°, more preferably about from 4° to 6°, and most preferably 5°.

Figure 3:
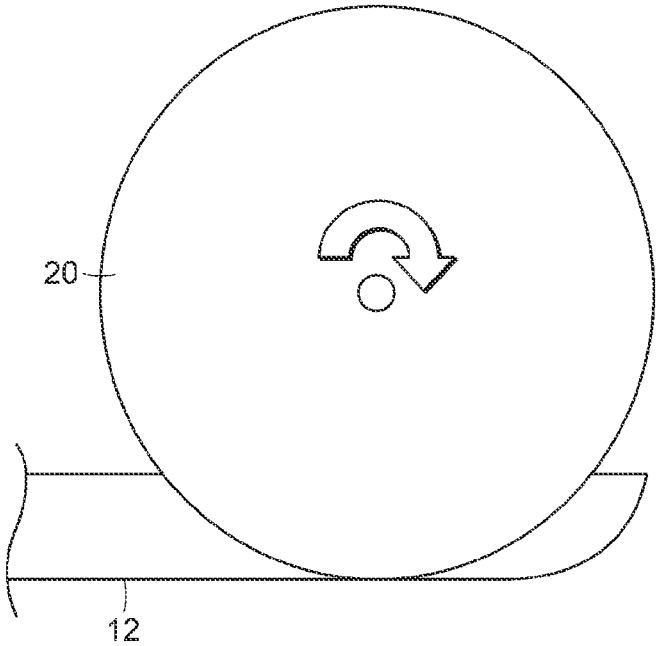
FIG. 3 shows a preferred groove cutting setup.

Grooves 12 are radiused at the toe and heel portions of the club head 1, and are about 0.02 inch deep at a geometric center of the face 11. Grooves 12 are machined into the strike face surface 11. The club head 1 is retained in a mold, which preferably is formed of a material soft enough to not damage the club head 1 yet resilient enough to firmly retain the golf club head 1, and a cutter, preferably a round cutter or a saw cutter, is used to form the grooves 12. As shown, the toe and heel portions are radiused about an axis of rotation that is perpendicular to a longitudinal axis of the groove. Furthermore, that axis of rotation is approximately parallel to face 11 of club head 1. Preferred cutters have a diameter from ⅜ inch to ¾ inch. A preferred range of groove radii include from 0.125 inch to 5 inches, with 0.25 inch to 2.5 inches being more preferred. Having radiused grooves 12 facilitates removal of dirt, grass, sand, and other materials that typically become embedded within the grooves of a golf club during normal use by eliminating corners that can trap these materials. FIG. 3 shows a preferred groove cutting setup illustrating cutter 20 with groove 12.

Figure 4:
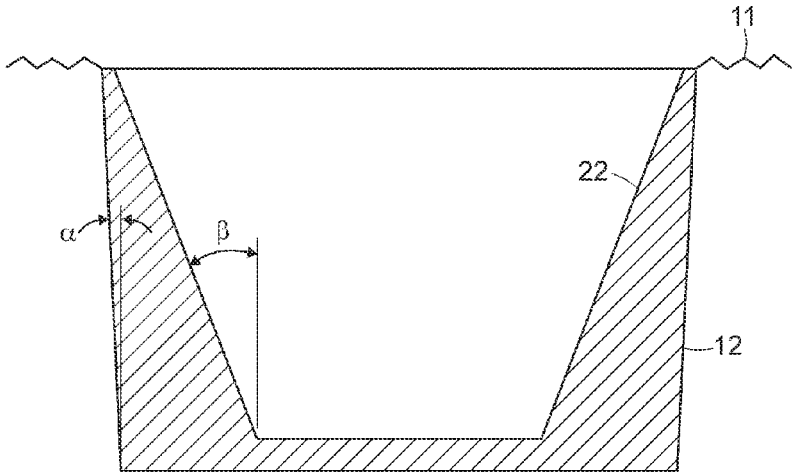
FIG. 4 shows a comparison of a groove of the golf club head of FIG. 1 as viewed along lines 4-4 of FIG. 2 with a known groove.

Machining the grooves 12, in addition to decreasing the draft angle, increases the rate of production and allows for tighter tolerances than casting or forging. The rate of production is increased by decreasing the number of required manufacturing steps. Instead of inserting the tool into the club face, machining the grooves, and removing the tool from the club face in three separate steps, as required by known groove creating processes, the present invention allows all three to be combined into one step. This is possible because the turning axis of the present cutter is parallel to the face, rather than the perpendicular axes of known processes. The tighter tolerances possible with the present invention allow less material to be removed, also decreasing manufacturing time. FIG. 4 shows a comparison of a groove 12 of the present invention with a typical groove 22 of known golf club heads. The groove 12 preferably has a depth of 0.02 inch, which is the USGA limit. Due to loose tolerances, known grooves 22 were designed well short of this limit. Similarly, known manufacturing processes required a large draft angle β, typically around 16°. The draft angle α of grooves 12 is much smaller, increasing the cross-sectional area of the groove and groove volume for a given length.

As noted above, the governing bodies of golf place limitations of the geometry of grooves 12. The increased tolerance control afforded by machining the grooves 12 of the present invention allows the actual groove geometry to be closer to the limits than was previously achievable. Thus, the grooves 12 of the present invention maximize groove volume, enhancing the groove performance during use. With the improved grooves of the present invention, the grooves better grip the ball, allowing a golfer to apply more spin to the ball. The golfer's control over the ball, both during ball flight and subsequent to flight, such as when landing and settling on a golf green, are increased. The grooves 12 of the present invention also result in a golf club head that is more aesthetically pleasing and that allows better ball control.

Figure 5:
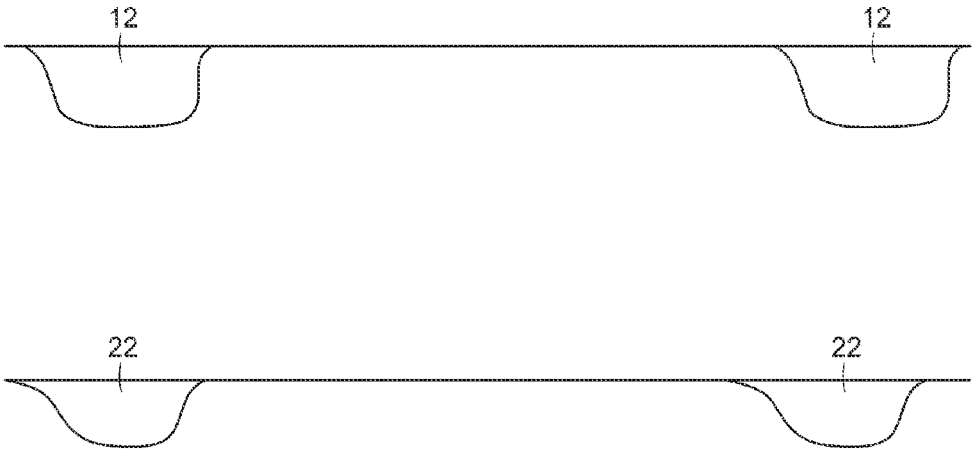
FIG. 5 shows a comparison of a groove of the golf club of FIG. 1 and a known groove.
Figure 6:
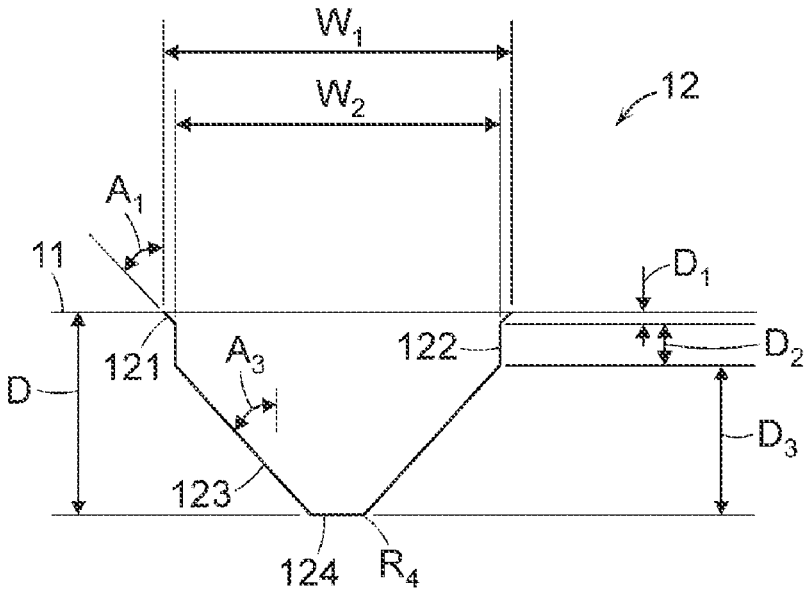
FIGS. 6-9 each show a cross-section of a preferred groove of the present invention.
Figure 7:
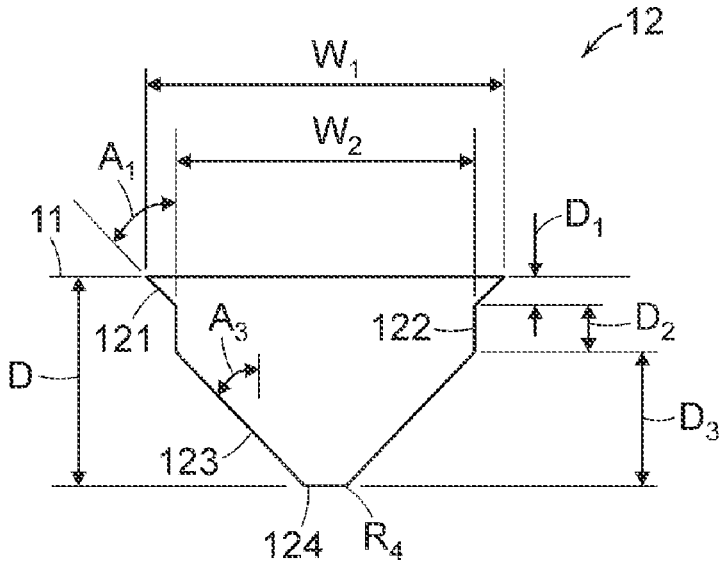
Figure 8:
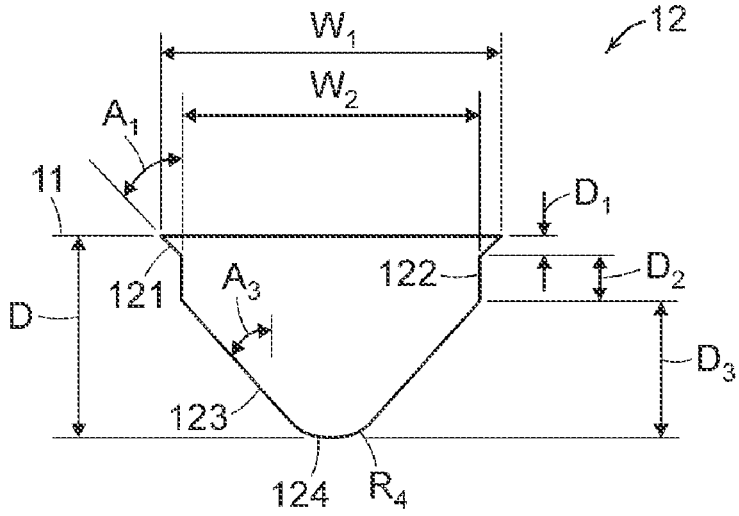
Figure 9:
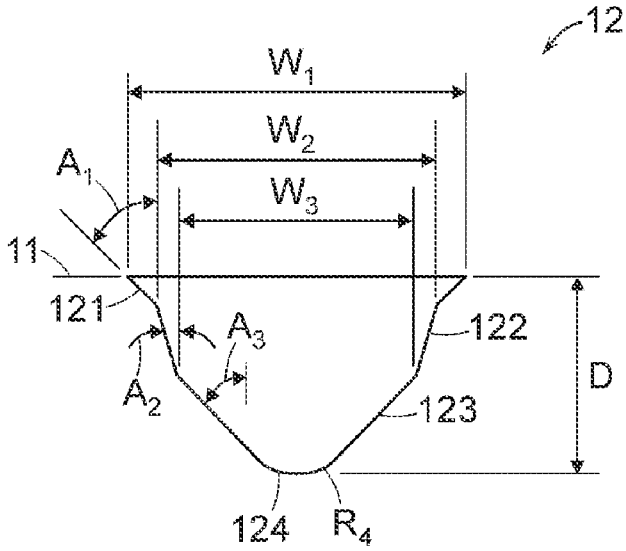

FIG. 5 shows a comparison of a groove 12 of the present invention with a typical groove 22 of known golf club heads. The known grooves 22 are quite rounded. The grooves 12 of the present invention, however, are much sharper. The edges are more defined, the depth is greater, and the dimensions are more consistent and closer to the limits. All of these factors allow the golf club head 1 to better grip the golf ball, increasing the user's control over the ball.

The face 11 of the club head 1 of the present invention is also enhanced to provide additional ball control and enhanced performance. The strike surface 11 is provided with a roughened texture. A common measure of roughness in surface finish is average roughness, Ra. Ra, also known as Arithmetic Average (AA) and Center Line Average (CLA), is a measure of the distance from the peaks and valleys to the center line or mean. It is calculated as the integral of the absolute value of the roughness profile height over the evaluation length:

$$Ra = \frac{1}{L}\int_0^L |r(x)|dx$$

The face 11 is roughened by machining, preferably with a Computer Numerically Controlled (CNC) mill. Known golf clubs have a face roughness at most 40 Ra. At least a portion of the face 11 in the proximity of the grooves, and more preferably the entire face 11, is machined such that it has a substantially uniform textured surface with a roughness greater than 40 Ra. Preferably, the roughness is from 75 Ra to 300 Ra, more preferably from 100 Ra to 200 Ra, and most preferably from 120 Ra to 180 Ra.

Providing a textured strike face allows the golfer to apply more friction to the ball during use, allowing the golfer to put more spin on the ball and have greater control of the ball. Conventionally, golfers have to take a full swing to induce enough golf ball spin to control the ball movement on a golf green. With the golf club head of the present invention, a golfer can induce golf ball spin in "partial" shots, or shots when the golfer is not taking a full swing. The textured strike surface of the present invention also distributes the shear force resulting from the golf swing over a greater area of the golf ball. This reduces cover damage and extends golf ball life.

The golf club head 1 preferably is formed of a soft base metal, such as a soft carbon steel, 8620 carbon steel being an example. A chrome finish may be applied to the base metal to inhibit wear and corrosion of the base metal. If included, the chrome finish preferably includes a non-glare layer. The chrome finish layer preferably has a thickness between 0.005 μin and 280 μin, with 80 μin a preferred thickness. A nickel finish may additionally be applied to the base metal as a sub-layer for chrome or another finish layer or may alternatively be applied to the base metal as the finish layer. If included, the nickel finish preferably has a thickness between 400 μin and 1200 μin, with 800 μin a preferred thickness.

In use, the grooves 12 and strike face 11 of the present invention enhance performance, especially in adverse conditions. The higher friction possible with the golf club head 1 allows a tighter grip on the golf ball during "wet" or "grassy" conditions than was previously possible. The club head of the present invention was tested, and as shown in Table 1 below, the generated revolutions per minute of a struck golf ball were substantially the same as those generated with a conventional club for a full dry shot, but were increased in a half dry shot and in both a full wet shot and a half wet shot. The "dry" shots contained substantially no moisture on the club face and ball. For the "wet" shots, the club face and/or the golf ball surface were sprayed with water in an amount that would be typical for shots made during a round in dewy or rainy conditions. A 60° wedge was used in these tests. Table 1 shows the revolutions per minute of a golf ball after being struck with a standard club or a spin milled club of the present invention, and illustrates the benefit of the spin milled grooves over standard grooves.

TABLE 1

| Shot Conditions | Standard | Spin Milled |
|---|---|---|
| Dry - full | 12250 | 12000 |
| Dry - half | 6500 | 7750 |
| Wet - full | 8000 | 12000 |
| Wet - half | 4000 | 8000 |

A preferred method of making the club head 1 includes first making a club head body. This may be done by casting, forging, or any other manufacturing method. The face is then machined such that it is substantially smooth and flat, preferably flat within ±0.002 inch. This preferably may be done by fly-cutting the face, which is cutting with a single-point tool fixed to the end of an arm protruding from a vertical milling shaft. Having a flat face allows the golfer to achieve consistent results during use. The body preferably is nested during the face flattening process. That is, the body is retained within a housing such that it is substantially immobile. The face is left exposed so that it can be worked on. The housing may be padded or otherwise designed such that it does not damage the club head.

Once the requisite face flatness has been achieved, the grooves are created and the surface is roughened as described above. While it is preferred that the grooves be spin milled prior to roughening the surface, the order of these steps is not essential. In fact, it is possible that they be performed substantially simultaneously, or with at least some amount of overlap.

The spin milled grooves may have very sharp edges, which could have an adverse effect on a golf ball during use. Thus, the grooves may be deburred to remove any sharp edges in the groove-to-face junction. This creates a radius at the junction, the radius preferably being less than 0.01 inch. This deburring can be carried out in a variety of ways. The junction may be filed, such as with a wire brush or a file, such as a carbide file. In conjunction with filing, or as an alternative method, the junction can be deburred by blasting. This may include impacting small beads at the junction at high speeds. To protect the face of the club head, which may have already been roughened above 40 Ra, the face may be masked. Masking includes placing a physical barrier on the face adjacent the grooves such that the projected particles cannot impact the face. Alternatively or in conjunction with masking, a nozzle can be used to accurately direct the projected material only at the junction.

The face point of contact with the ball varies depending upon the particular golf shot being performed. If the ball is lying on the fairway and the golfer takes a "regular" swing (as opposed to a chip shot swing or a flop shot swing, for example), then the golfer strives to make contact with the ball on the lower portion of the club face, typically the lower, central portion of the club face. For the same type of swing but with the ball positioned in the rough, however, contact may likely be made higher on the club face due to the ball "sitting up" in the longer grass of the rough. The likelihood of water, grass, and other debris being intermediate the club face and ball at contact is also greater for this latter shot condition. Still other portions of the club face, such as the central portion, may contact the ball during other types of golf shots. Thus, it may be beneficial to design the individual face grooves as a function of their intended use. This is contrary to conventional wisdom, according to which all grooves on a club are the same.

Accordingly to one aspect of the present invention, spin milled grooves are provided on the upper portion of the striking face 11, near the top line 14. Exemplary spin milled grooves are described herein above and below. As explained above, these grooves yield better results in wet and grassy conditions. For other portions of the club face, standard grooves may provide adequate results. Thus, such standard grooves may be provided on the lower portion of the striking face 11, near the leading edge and the sole 13.

Figure 15:
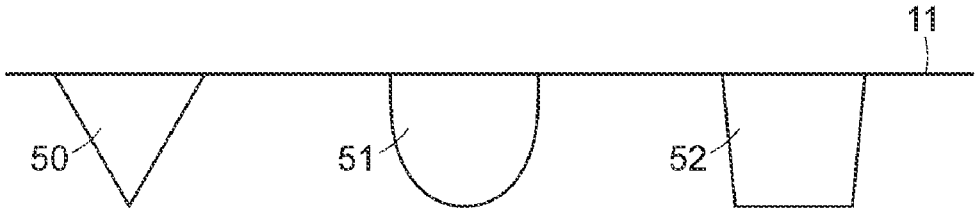
FIG. 15 shows a partial cross-sectional view of a golf club head of the present invention.

Varying forms of grooves may also be provided. So called "V-grooves" and "U-grooves" may be included on the striking face 11, as well as spin milled grooves. V-grooves contain converging side walls that are spaced apart at the face surface 11 and join at the bottom of the groove, giving the groove cross-section a V-shape. U-grooves also having converging side walls, but instead of converging to a point, the junction between the side walls is rounded, giving the groove cross-section a U-shape. Of course, for a variety of reasons, the side wall to side wall and side wall to striking surface junctions may be radiused or chamfered. FIG. 15 shows a partial cross-sectional view of a club face 11 having three different types of grooves formed therein, including a V-groove 50, a U-groove 51, and a spin milled groove 52. While each of the grooves 50, 51, 52 in this illustrated example have the same width at the face 11 and the same depth, these values could of course be varied among the individual grooves.

In one setup, V-grooves are provided on the lower portion of the face 11 toward the sole 13, spin milled grooves are provided on the upper portion of the face 11 toward the top line 14, and U-grooves are provided on the central portion of the face 11 intermediate the V-grooves and the spin milled grooves. Thus, referring to FIG. 15, the club head would be oriented with the sole toward the left side of the page and the top line toward the right side of the page.

Figure 16:
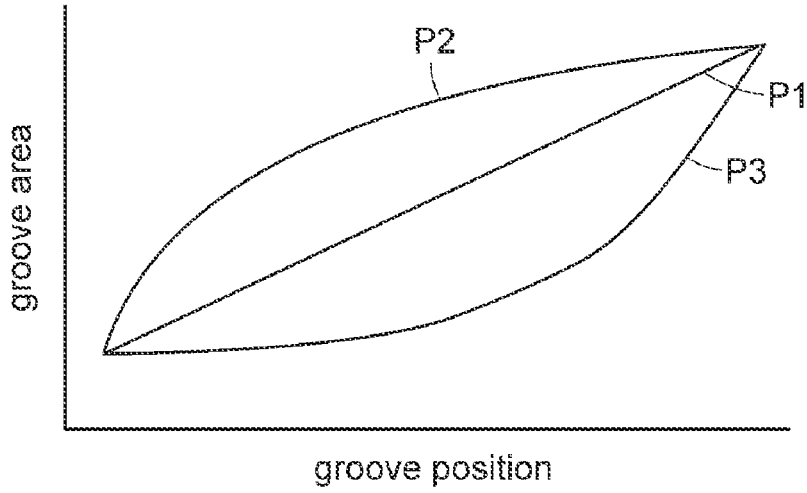
FIG. 16 shows groove position between the sole and the top line versus groove volume.

Another way of describing the groove placement scheme is as a function of the groove cross-sectional area. Following the above example, grooves having a greater cross-sectional area may be placed toward the top line of the club head and grooves having a smaller cross-sectional area may be placed toward the sole of the club head. Thus, the groove cross-sectional area is biased toward the top of the club head. In an embodiment, because of the bias in the cross-sectional area of the grooves, a majority of the total groove volume of the club head is positioned above the club head center of gravity. The cross-sectional area of adjacent grooves may increase linearly, with each cross-sectional area being a multiple of the cross-sectional area of an adjacent groove. This is illustrated as plot P1 on FIG. 16, which shows groove position between the sole and the top line versus groove cross-sectional area (referred to as "groove area"). Alternatively, the cross-sectional areas may vary exponentially across the club face, as illustrated in plots P2 and P3 of FIG. 16. Again following the above example, the club head would be oriented with the sole toward the left side of the page and the top line toward the right side of the page for FIG. 16.

The groove cross-sectional area may be varied in sets of grooves. In other words, the grooves are grouped into two or more sets of grooves, with all of the grooves of a particular set having the same cross-sectional area. However, the groove cross-sectional area is different for each groove set. The grooves of the first set all have the same cross-sectional area, while the grooves of the second set all have the same cross-sectional area but being different than that of the first set of grooves. More than two sets of grooves may be provided. The cross-sectional shapes may also be different for each set of grooves, with contemplated shapes including V-grooves, U-grooves, and "square" spin milled grooves.

Rather than being provided in sets of identical grooves, each individual groove may have a unique cross-sectional area. More than one of a particular type of groove—V-grooves, for example—may be provided, but with varying cross-sectional area. One way of accomplishing this is by changing the groove width at the striking face and/or the groove depth among the different grooves.

For the purposes of this discussion, the cross-sectional areas are measured in a plane that is perpendicular to the strike face 11, vertically oriented in the sole 13 to top line 14 direction, and that passes through a central region of the club head between the heel 15 and the toe 16. The club head center of gravity may be located in this plane.

While the discussion herein has focused on biasing the groove volume toward the top of the club head, one could of course follow the teachings herein and provide different groove volume concentrations. One such alternate design includes biasing the groove volume toward the bottom of the club head. The launch angle of a golf shot tends to increase the higher the ball is struck on the club face, so this bottom-biased groove volume design may be preferred for mid- and long-irons. These clubs are not typically used for relatively short shots from the rough, when maintaining or maximizing spin is a primary concern. Rather, higher face contact point shots with these clubs more typically result from golfer error than course conditions. Thus, to help minimize distance lost resulting from the higher launch angle, a lower spin may be preferred. For such a top biased groove configuration, the club head would be oriented with the sole toward the right side of the page and the top line toward the left side of the page for FIGS. 15 and 16. Another alternate design includes changing the groove cross-sectional area as a function of distance from the club head center of gravity. The groove overlying or closest to the club head center of gravity could have the smallest cross-sectional area with cross-sectional areas of adjacent grooves getting progressively larger. The rate of increase in cross-sectional area could be the same when progressing toward the top line as when progressing toward the sole, or the rates could be different. Alternatively, the groove overlying or closest to the club head center of gravity could have the greatest cross-sectional area with the other grooves being smaller.

The grooves on the face of a club may also be varied among the clubs in the set. The set generally includes irons that are designated number 1, 2, or 3 through number 9, though the long irons may be provided as hybrid- or utility-type clubs. (Hybrid and utility clubs are considered to be iron-type club heads herein.) The set also generally includes one or more wedges, such as a pitching wedge, a gap wedge, a sand wedge, and/or a lob wedge. Each iron has a length that usually decreases through the set as the loft for each club head increases from the long irons to the short irons. The length of the club, along with the club head loft and center of gravity impart various performance characteristics to the ball's launch conditions upon impact. The initial trajectory of the ball extends between the impact point and the apex or peak of the trajectory. Long irons, like the 3 iron, produce a more penetrating initial trajectory. Short irons, like the 9 iron or pitching wedge, produce an initial trajectory that is less penetrating than the trajectory of balls struck by long irons. The highest point of the long iron's ball flight is lower than the highest point for the short iron's ball flight. The mid irons, such as the 6 iron, produce an initial trajectory that is between those exhibited by balls hit with the long and short irons.

Varying the grooves on respective iron-type clubs within the set provides the appropriate groove for the club's individual launch conditions. As the loft angle decreases from the short irons, through the mid-irons, to the long irons, the shaft length increases, and the launch angle and imparted back spin decrease. Thus, groove volume or groove cross-sectional area may be determined as a function of these club head characteristics. A preferred relationship for the grooves of a particular club is as a function of the club head loft angle, being directly related thereto. That is, the groove cross-sectional area decreases as the loft angle decreases. Another preferred relationship is as a function of shaft length, being inversely related thereto. That is, the groove cross-sectional area decreases with an increase in shaft length. These correlations may be either linear or exponential, as determined by the club head designer. In a preferred set of golf club irons of the instant invention, the short irons in the set have spin milled grooves while the middle irons have U-grooves and the long irons have V-grooves. An average of the groove cross-sectional areas across the club face may be used herein for ease of consideration and calculation.

As used herein, a "set" of iron-type golf clubs means a selection of irons that a golfer would typically carry during a round of golf. The set includes at least three or more clubs, more preferably five or more clubs. However, "set" does not mean a group of clubs that the user is expected to pick one of (for example, a plurality of 5 irons is not a set of clubs as used herein).

FIGS. 6-9 each show a cross-section of a preferred groove 12 that may be formed by the method described above. The groove 12 includes a first portion 121 adjacent to and interacting with the club face 11. In this illustrated embodiment, the edges of the groove 12 have been deburred, either having a radius or being angled. An angled edge is preferred for the spin milling process described above, and a preferred range of angles $A_1$ is about 10° to 50°. The width $W_1$ of the groove 12 at the strike face 11, which is the widest portion of the groove 12, is about 0.035 inch. This corresponds to the maximum width allowable by the USGA. This width transitions narrower through the first groove portion 121 to a width $W_2$ between about 0.033 and 0.027 inch at the lowermost boundary of the first portion 121. The first portion 121 is shallow, preferably having a depth $D_1$ of less than 0.005 inch, with 0.001 to 0.003 inch being more preferred. The first portions of the illustrated embodiments of FIGS. 6-9 are similar, but extending to varying depths $D_1$. The embodiment illustrated in FIG. 6 has the shallowest depth $D_1$, and the embodiment illustrated in FIG. 7 has the deepest depth $D_1$.

The groove 12 includes a second portion 122 adjacent to the first portion 121. This portion 122 preferably has substantially parallel walls that are substantially perpendicular to the face 11, "substantially" herein meaning the walls may be angled at an angle $A_2$ of up to about 20°. Preferably, the walls defining the second portion 122 are spaced as far apart as possible to maximize the volume of the groove 12. A preferred range of widths $W_2$, $W_3$ is about 0.033 to 0.027 inch. In relative terms, the maximum width $W_2$ of the second portion 122 preferably may be from about 80% to 98% of the maximum groove width $W_1$. Preferably, the width $W_3$ at a bottom portion of the second portion 122 is at least about 80% of the width $W_2$ at a top portion of the second portion 122. A preferred range of depths $D_2$ is between about 0.005 and 0.008 inch. In some preferred embodiments, the second section depth $D_2$ is at least half the overall groove depth D. The overall groove depth D preferably is between about 0.0175 and 0.0225 inch, more preferably about 0.02 inch.

The groove 12 includes a third portion 123 adjacent to the second portion 122. This portion 123 has a V-shape, having an angle $A_3$ of about 90°. Thus, the width of the third portion 123 decreases from the top portion thereof (nearest the face 11) to the bottom portion thereof. Preferably, the width at the bottom of the third portion is less than about half of the width of the top portion. In some preferred embodiments, the depth $D_3$ of this third section 123 may be from about 0.012 to 0.015 inch. The depth $D_3$ of this third section 123 preferably is at least twice the depth $D_2$ of the second portion 122. In some preferred embodiments, the third portion 123 has a depth $D_3$ that is about 60% to 75% of the overall groove depth D.

The groove 12 includes a fourth portion 124 adjacent to the third portion 123. This portion 124 is radiused to join the walls of the third section 123. A preferred radius $R_4$ is less than 0.012 inch.

Another way to quantify the grooves is by pitch ratio. Pitch ratio P is calculated according to the following formula:

$$P = \frac{A}{W + S}$$

where A is the cross-sectional area of the groove, W is the groove width (measured at the face surface), and S is the spacing between adjacent grooves. The pitch ratio P thus has the units of length$^2$/length. The governing bodies of the Rules of Golf have proposed new rules limiting the pitch ratio P to be less than 0.0025 in.$^2$/in.

Figure 10:
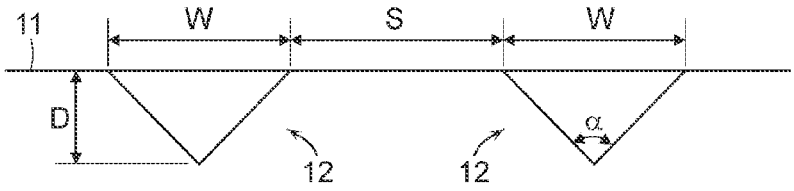
FIG. 10 shows a cross-section of a preferred groove of the present invention.
Figure 11:
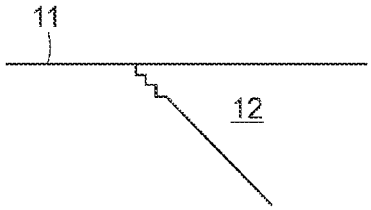
FIG. 11 shows a stepped face-groove junction of the present invention.

FIG. 10 shows a cross-section of a preferred groove 12 that may be formed by the spin mill method described above. The line of the face 11 has been extended across the groove 12 for illustrative purposes. This groove 12 may be referred to as a "V-groove," as the side walls converge from points adjacent the face 11 toward their union at the bottom of the groove 12. This union may be radiused as discussed above. Preferably, the face-groove junctions are deburred to avoid sharp edges that may cut or otherwise damage a golf ball. For example, the groove edges may be radiused or angled. Exemplary angles include the range of 0.005 in. to 0.02 in. The face-groove junctions may also contain a series of steps, each of which may or may not be radiused. A stepped face-groove junction is illustrated in FIG. 11. While three steps are shown in this exemplary embodiment, more or fewer steps could be included. A preferred number of steps include the range of 1 to 10 steps. The use of a stepped face-groove junction may increase the golfer's ability to impart spin to the ball, enhancing the golfer's ability to control the ball flight and landing/settling characteristics. A preferred range for the length of the rise (the "vertical" part of the step) and run (the "horizontal" part of the step) of each step includes the range of 0.0015 in. to 0.01 in. It is preferred that the rise(s) and run(s) be of the same dimension, but they may also be constructed such that the rise is greater than the run or vice versa. Additionally, it is possible that individual rises of a plurality of rises may be of the same or differing values. The runs may also be of similar of dissimilar values. This stepped face-groove junction can be used with any of the grooves described herein.

The maximum allowable groove width W allowed by the Rules of Golf is 0.035 in., and the space S between edges of adjacent grooves must be no less than three times the groove width W and not less than 0.075 in. Additionally, the maximum groove depth D allowed by the Rules of Golf is 0.02 in. Setting the width W to 0.035 in. and the spacing S to 0.105, the only variable in the pitch ratio calculation is the cross-sectional area A. The area A, of course, is a function of the groove depth, groove width, and wall angles. Turning to the grooves illustrated in FIG. 10, the grooves 12 may be characterized by the inclusive angle $\alpha$ formed by the two side walls. (The inclusive angle $\alpha$ is equivalent to twice the draft angle $\beta$.) Preferred values for the inclusive angle $\alpha$ include the range of 85° to 95°, with 90°±3° being more preferred. The depth D of these grooves may be less than 0.02 in. Preferably, the depth D is within the range of 0.015 in. to 0.02 in., 0.015 in. to 0.018 in. being more preferred. This yields a groove area A that is within a preferred range of 0.00026 $in^2$ to 0.00035 $in^2$. And thus the pitch ratio P is approximately 0.0025 $in.^2/in$ or less.

Figure 12:
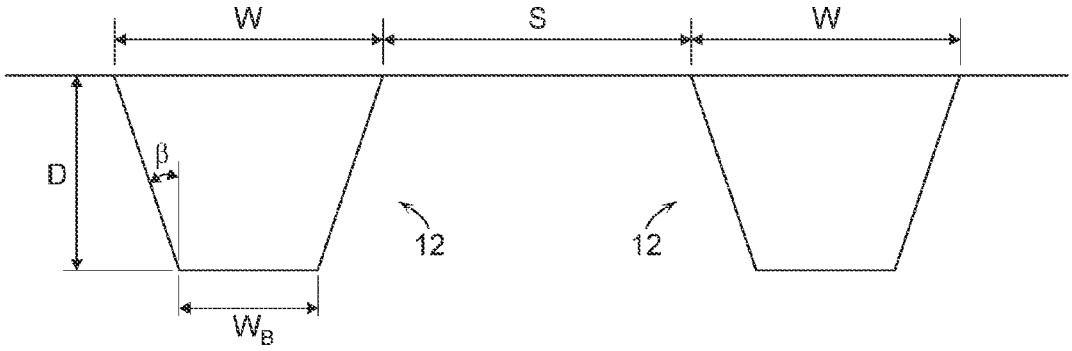
FIGS. 12-14 each show a cross-section of a preferred groove of the present invention.

FIG. 12 shows a cross-section of another preferred groove of the present invention. This illustrated groove is similar to a V-groove, but has a bottom wall such that the side walls do not intersect. These grooves 12 may be characterized by their draft angle $\beta$, which preferably may be within the range of 30° to 40°, 35°±3° being more preferred. Setting the depth D and width W to the maximum allowable dimensions yields an area A of 0.00037 $in.^2$ to 0.00047 $in.^2$, more preferably approximately 0.0004 $in^2$. The width $W_B$ of the bottom wall may also be used to characterize the groove 12. Preferably, the bottom wall width $W_B$ is ⅓ to ⅙ the groove width W, with ¼ to ⅕ being more preferred. Again, preferably the pitch ratio P is approximately 0.0025 $in.^2/in$ or less. The junctions between the side and bottom walls may be radiused, in which case the bottom wall width $W_B$ may be measured between intersections of bottom and side wall extensions. That is, the bottom wall width $W_B$ may be measured as if the junctions were not radiused. Decreasing the draft angle $\beta$ of the groove 12 illustrated in FIG. 12 modifies its shape such that it may be categorized as a "U-groove." Preferred values for the draft angle $\beta$ include 12° to 20°, with 16°±2° being more preferred. In this instance, the depth D preferably is less the maximum allowable, and within the range of 0.018 in. to 0.02 in. Similarly, the width W may be slightly less than the maximum allowable dimension, for example within the range of 0.03 in. to 0.035 in. This yields an area A of approximately 0.0004 $in.^2$ to 0.0005 $in.^2$ Again, preferably the pitch ratio P is approximately 0.0025 $in.^2/in.$ or less.

To simplify the groove cross-sectional area and pitch ratio calculations, any steps that may be used to form the face-groove junction may be ignored. Of course, such steps may be taken into account when making the calculations.

Figure 13:
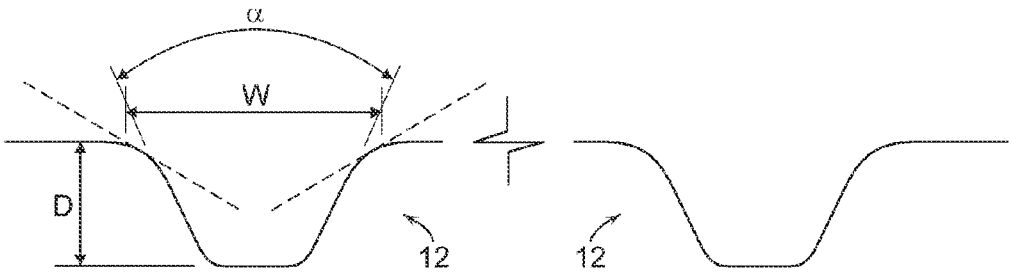

One way to enhance the functionality of the grooves 12 of a golf club head is to increase the volume of the individual grooves. One such preferred groove design is shown in FIG. 13. In this illustrated example, the spacing S is not held to the minimum value and is instead increased, thus allowing an increased area A and still yielding pitch ratio P values within the preferred range. The inclusive angle $\alpha$ formed by the side walls preferably is within the range of 50° to 55°, with 52°±1° being more preferred. The groove width W preferably is maximized to 0.035 in., but 0.032 in.±0.002 in. is also preferred. Similarly, while the depth D preferably is maximized to 0.02 in., 0.017 in.±0.002 in. is also preferred. This yields a groove area A that is within the range of 0.00035 $in.^2$ to 0.00039 $in.^2$, taking into consideration the fact that the face-groove junctions and the side wall-bottom wall junctions are all radiused. Increasing the groove spacing S above the minimum allowable to 0.175 in. to 0.185 in., with 0.179 in.±0.002 in. being more preferred, yields a pitch ratio P that is less than 0.0025 $in.^2/in.$, and approximately equal to 0.0021 $in.^2/in.$ Expanding upon this idea, the spacing S may be further increased above the minimum value to, for example, 0.2 in. or 0.25 in.

Figure 14:
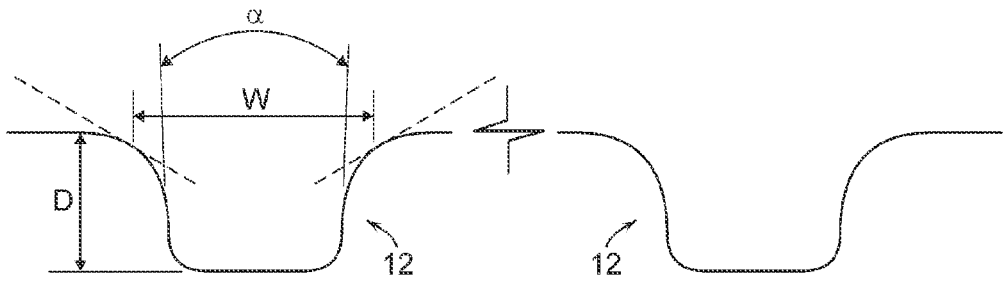

FIG. 14 illustrates another groove 12 of increased volume. Here, again, the spacing S is increased above the minimum allowed value. The inclusive angle $\alpha$ formed by the side walls preferably is within the range of 2° to 10°, with 4°±1° being more preferred. This gives the groove 12 a U-shape. The groove width W preferably is maximized to 0.035 in., but 0.032 in.±0.002 in. is also preferred. Similarly, while the depth D preferably is maximized to 0.02 in., 0.017 in.±0.002 in. is also preferred. This yields a groove area A that is within the range of 0.00039 $in.^2$ to 0.00043 $in.^2$, again taking into consideration the fact that the face-groove junctions and the side wall-bottom wall junctions are all radiused. These dimensions yield a pitch ratio P that is less than 0.0025 $in.^2/in.$, and approximately equal to 0.0021 $in.^2/in.$ The bottom wall width $W_B$ may be 80% to 95% of the groove maximum width W measured at the strike face 11.

Recitation of ranges of values herein are merely intended to serve as a shorthand method of referring individually to each separate value falling within the range, unless otherwise indicated herein, and each separate value is incorporated into the specification as if it were individually recited herein.

As used herein, directional references such as rear, front, lower, bottom, upper, top, etc. are made with respect to the club head when grounded at the address position. See, for example, FIG. 1. The direction references are included to facilitate comprehension of the inventive concepts disclosed herein, and should not be read or interpreted as limiting.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf club head, comprising:

a body having a striking face with a plurality of grooves formed therein, said plurality of grooves including a first groove having a first cross-sectional area, a second groove having a second cross-sectional area, and a third groove having a third cross-sectional area, wherein each of said first, second, and third cross-sectional areas are different from the other cross-sectional areas, and wherein at least one of said first, second and third grooves is shallow at both toe and heel portions and deep in a central region.

2. The golf club head of claim 1, wherein said first groove is a U-groove and said second groove is a V-groove.

3. The golf club head of claim 1, wherein at least one of said plurality of grooves has a longitudinal axis and is radiused at toe and heel portions thereof about an axis of rotation that is perpendicular to said longitudinal axis and parallel to the striking face.

4. The golf club head of claim 3, wherein the at least one of said plurality of grooves is radiused at toe and heel portions with a radius in a range of 0.125 inch to 5 inches.

5. The golf club head of claim 4, wherein the radius is in a range of 0.25 inch to 2.5 inches.

6. The golf club head of claim 1, wherein:

said body contains a sole and a top line;

said first cross-sectional area is greater than said second cross-sectional area, and said second cross-sectional area is greater than said third cross-sectional area;

said first groove is positioned between said top line and said second groove; and said third groove is positioned between said sole and said second groove.

7. The golf club head of claim 1, wherein:

said body further includes a top line; and said plurality of grooves has a total volume, a majority of said total volume being positioned between a center of gravity of the club head and said top line.

8. The golf club head of claim 1, wherein cross-sectional areas of adjacent ones of said plurality of grooves increase in a vertical direction of travel along said striking face, said cross-sectional areas being measured in a vertical plane substantially perpendicular to the striking face of the club head and passing through a center of gravity of the club head.

9. A golf club head, comprising:

a body having a striking face with a plurality of grooves formed therein, said plurality of grooves including a first groove having a first cross-sectional area, a second groove having a second cross-sectional area, and a third groove having a third cross-sectional area, wherein each of said first, second, and third cross-sectional areas are different from the other cross-sectional areas, and wherein at least one of said first, second and third grooves is shallow at both toe and heel portions and deep in a central region such that the groove defines a maximum depth distance that is at least 0.25 inch shorter than an overall distance of the groove.

10. The golf club head of claim 9, wherein said first groove is a U-groove and said second groove is a V-groove.

11. The golf club head of claim 9, wherein at least one of said plurality of grooves has a longitudinal axis and is radiused at toe and heel portions thereof about an axis of rotation that is perpendicular to said longitudinal axis and parallel to the striking face.

12. The golf club head of claim 11, wherein the at least one of said plurality of grooves is radiused at toe and heel portions with a radius in a range of 0.125 inch to 5 inches.

13. The golf club head of claim 12, wherein the radius is in a range of 0.25 inch to 2.5 inches.

14. The golf club head of claim 9, wherein:

said body contains a sole and a top line;

said first cross-sectional area is greater than said second cross-sectional area, and said second cross-sectional area is greater than said third cross-sectional area;

said first groove is positioned between said top line and said second groove; and said third groove is positioned between said sole and said second groove.

15. The golf club head of claim 9, wherein:

said body further includes a top line; and said plurality of grooves has a total volume, a majority of said total volume being positioned between a center of gravity of the club head and said top line.

16. The golf club head of claim 9, wherein cross-sectional areas of adjacent ones of said plurality of grooves increase in a vertical direction of travel along said striking face, said cross-sectional areas being measured in a vertical plane substantially perpendicular to the striking face of the club head and passing through a center of gravity of the club head.

17. A golf club head, comprising:

a body having a striking face with a plurality of grooves formed therein, said plurality of grooves including a first groove having a first cross-sectional shape, a second groove having a second cross-sectional shape, and a third groove having a third cross-sectional shape, wherein each of said first, second, and third cross-sectional shapes are different from the other cross-sectional shapes, wherein at least one of said first, second and third grooves is shallow at both toe and heel portions and deep in a central region such that the groove defines a maximum depth distance that is at least 0.25 inch shorter than an overall distance of the groove, wherein at least one of said plurality of grooves has a longitudinal axis and is radiused at toe and heel portions thereof about an axis of rotation that is perpendicular to said longitudinal axis and parallel to the striking face, and wherein the at least one of said plurality of grooves is radiused at toe and heel portions with a radius in a range 0.25 inch to 2.5 inches.

18. The golf club head of claim 17, wherein:

said body contains a sole and a top line;

said first grooves has a first cross-sectional area that is greater than a second cross-sectional area of the second groove, and said second cross-sectional area is greater than a third cross-sectional area of the third groove;

said first groove is positioned between said top line and said second groove; and said third groove is positioned between said sole and said second groove.

19. The golf club head of claim 17, wherein:

said body further includes a top line; and said plurality of grooves has a total volume, a majority of said total volume being positioned between a center of gravity of the club head and said top line.

20. The golf club head of claim 17, wherein cross-sectional areas of adjacent ones of said plurality of grooves increase in a vertical direction of travel along said striking face, said cross-sectional areas being measured in a vertical plane substantially perpendicular to the striking face of the club head and passing through a center of gravity of the club head.

* * * * *